United States Patent [19]

Humphrey

[11] 3,948,420

[45] Apr. 6, 1976

[54] ELASTOMERIC PUMPS

[75] Inventor: Frederick Harold Humphrey, Markham, Canada

[73] Assignee: Polypump Limited, Norwood, N.J.

[22] Filed: Dec. 24, 1974

[21] Appl. No.: 536,197

[52] U.S. Cl. ..... 222/207; 222/212; 417/566

[51] Int. Cl.[2] ..... F04B 43/00

[58] Field of Search ..... 222/207, 212; 417/566

[56] References Cited

UNITED STATES PATENTS

| | | | |
|---|---|---|---|
| 2,562,317 | 7/1951 | Krall | 222/207 |
| 3,102,489 | 9/1963 | Corsette et al. | 222/383 X |
| 3,162,334 | 12/1964 | Miller | 222/207 |
| 3,486,663 | 12/1969 | Humphrey | 222/207 |
| 3,752,366 | 8/1973 | Lawrence | 222/207 |

*Primary Examiner*—Robert B. Reeves
*Assistant Examiner*—Frederick R. Handren
*Attorney, Agent, or Firm*—Sim & McBurney

[57] ABSTRACT

This invention provides the fluid-handling device which includes a curved base member of which the surface is closed upon its self, for example a truncated cone, and an elastomeric member adapted to receive and enclose the base member. The elastomeric member defines a number of chambers at its contact with the base member, these including an inlet chamber divided by a sloping partition integral with the elastomeric member, and a outlet chamber also divided by a sloping partition intergral with the elastomeric member. The elastomeric member also includes a dome adjacent the end or truncation of the base member, and this dome defines with the base member a chamber of variable volume, which is connected to the inlet and outlet chambers by suitable passageways which result in a pumping action when the dome is depressed and then released.

13 Claims, 8 Drawing Figures

ELASTOMERIC PUMPS

This invention relates generally to fluid-handling devices, and has to do particularly with a pump adapted to pump liquids by the exertion of finger-pressure.

As discussed in detail in this applicant's earlier U.S. Pat. No. 3,486,663, issued Dec. 30, 1969 under the title "Elastomeric Pump and Check-Valve", many spray containers currently available in the market place are equipped with small pumping mechanisms which suffer from a number of disadvantages. Among these disadvantages are the relatively high cost of manufacture due to the large number of parts required, the danger of clogging due to the pump construction including rigid materials, the risk of corrosion, and the difficulty of gaining access to the inner components for cleaning. A particular disadvantage of those conventional pumping mechanisms which involve a rectilinearly reciprocable piston is the fact that the user must depress the plunger along a given direction. Lateral pressure often causes binding and this makes these spray mechanisms awkward to use.

The elastomeric pump and check-valve set forth in this applicant's U.S. Pat. No. 3,486,663 overcomes many of these disadvantages by providing an elastomeric member intended for use with a substantially flat surface. The elastomeric member has a recess portion which can be clamped or otherwise held against the surface, and the later has two ports opening into the recess. Partitions divide the internal recess into two compartments for the check-valve embodiment and three compartments for the pump embodiment. The partitions are in sloping or oblique relation to the surface and because of this orientation act in the manner of check-valves.

While the pump disclosed and claimed in U.S. Pat. No. 3,486,663 represents a distinct improvement over the prior art, there remains room for additional refinement and improvement.

It is to the achievement of such further refinement and improvement that the present application is directed.

Accordingly, this invention provides, for use with a base member having a curved base wall closed upon itself and an end portion spanning across said curved base wall to define an end thereof, an integral elastomeric member comprising: (a) a closed curved wall portion having an inside and an outside; an inlet recess on the inside divided into upstream and downstream compartments by an inlet partition which is integral with said elastomeric member, which is adapted to rest resiliently against said base wall when the closed curved wall portion snugly embraces the said curved base wall, and which defines in the upstream compartment an acute angle with the part of the curved base wall it contacts when so resting; an outlet recess on the inside divided into upstream and downstream compartments by an outlet partition which is integral with said outlet elastomeric member, which is adapted to rest resiliently against said base wall when the closed curved wall portion snugly embraces said curved base wall, and which defines in said last-mentioned upstream compartment an acute angle with the part of the curved base wall it contacts when so resting; and (b) a deformable, self-restoring bulb portion capping said closed curved wall and adapted to define a pumping chamber with said end portion of the base member; and (c) recess means on said inside joining the pumping chamber to the downstream inlet compartment and to the upstream outlet compartment.

One embodiment of this invention is illustrated in the accompanying drawings, in which like numberals denote like parts throughout the several views, and in which.

Figure 8:
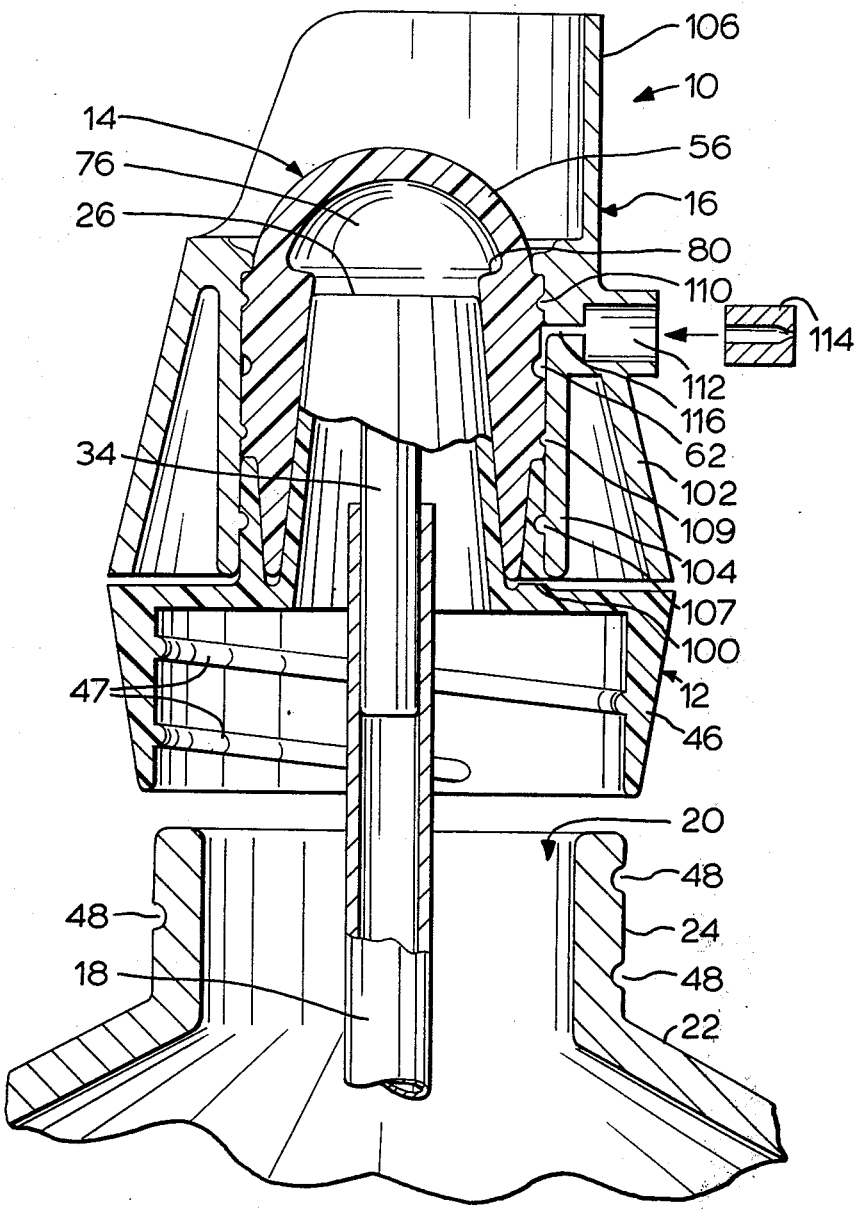
FIG. 8 is a sectional view of the complete assembly, including a shroud member.

Turning first to FIG. 8, a fluid-handling device shown generally at 10 is seen to include a base member 12, an elastomeric member 14, and a shroud member 16. As seen in FIG. 8, a feed tube is provided, which extends downwardly through the mouth 20 of a container 22. The container 22 may be a bottle or the like, and is intended to hold a fluid material such as liquid. In FIG. 8, the base member 12 is shown spaced above the neck 24 of the container 22, although in use the base member 12 is intended to be screwed firmly onto the neck 24.

Figure 6:
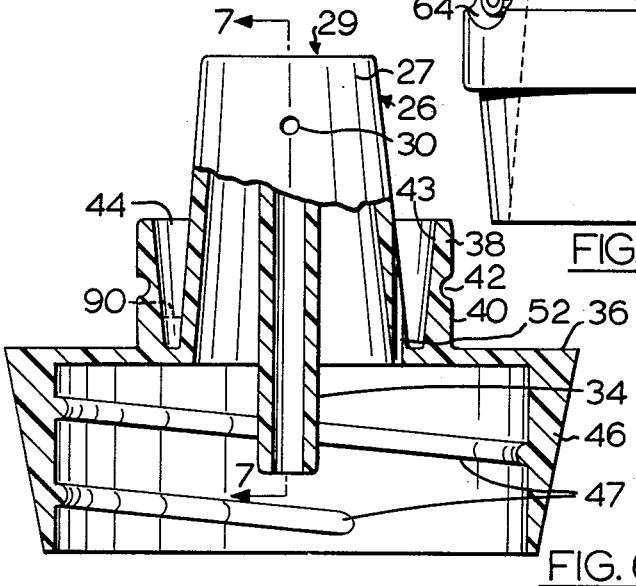
FIG. 6 is a partial elevation and partial sectional view of a base member with which the elastomeric member of FIG. 5 is adapted to cooperate.
Figure 7:
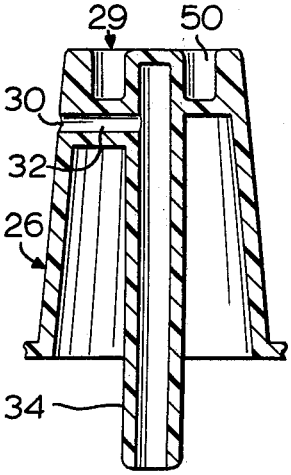
FIG. 7 is a sectional view taken at the line 7—7 in FIG. 6.

Referring now to FIGS. 6, 7 and 8, the base member 12 is seen more particularly to include a frusto-conical portion 26 which defines a curved base wall 27 of conical configuration which is closed upon itself in the sense of having a closed or unbroken lateral section, and an end portion 29 which spans across the end of the conically curved base wall 27, to define an edge thereof.

As can be seen in FIGS. 6 and 7, there is an opening 30 through the curved base wall 26 at an intermediate location thereof, the opening being the end of a substantially radial passageway 32 which communicates at its inward end with an axially oriented tubular portion 34.

The base member 12 also includes an outward annular flange 36 which supports an integral upstanding collar 38 concentric with the frusto-conical portion 26. The upstanding collar 38 has a substantially cylindrical outer wall 40 with an annular gallery 42 at an intermediate location, and further has a slightly upwardly and outwardly diverging inner wall 43. Between the inner wall 43 and the curved base wall 27 of the frusto-conical portion 26 there is defined an annular pocket 44 the purpose of which will be described below. The annular flange 36 is integral at its outer periphery with a downwardly depending collar portion 46 which, as seen in FIG. 8, is adapted to be screwed onto the neck 24 of the container 22. For this purpose, the interior of the downwardly depending collar portion 46 is provided with threads 47 adapted to mate with a helical recess 48 in the exterior of the neck 24 of the container 22.

As best seen in FIG. 7, the upper end of the frusto-conical portion 26 defines an annular recessed pocket 50 which does not play any part in the function of the device, but rather is present due to molding considerations.

As best seen in FIG. 6, the frusto-conical portion 26 includes a passage 52 which, as will be seen below, is part of a means for admitting air from the exterior to the inside of the container 22, in order to compensate for the loss of fluid or liquid volume in the container 22 due to the pumping action.

Attention is now directed to FIGS. 1 through 5 and 8, in connection with which the elastomeric member 14 will be more particularly described. As seen in these figures, the elastomeric member 14 generally includes two portions. The first is a closed curved wall portion 54, while the second is a deformable self-restoring bulb portion 56 which caps the closed curved wall portion.

The wall portion 54 is referred to as "closed" to designate that it is complete and unbroken in axial section. In the particular configuration shown in the figures, the wall portion 54 has (a) an internal frusto-conical surface 57 which is complementary with the frusto-conically curved base wall 27 of the frusto-conical portion 26 of the container 22, (b) a first external surface 59 which is frusto-conical and which diverges oppositely to the internal surface 57, and (c) a substantially cylindrical external surface 60 which has an intermediate annular recess 62.

Figure 3:
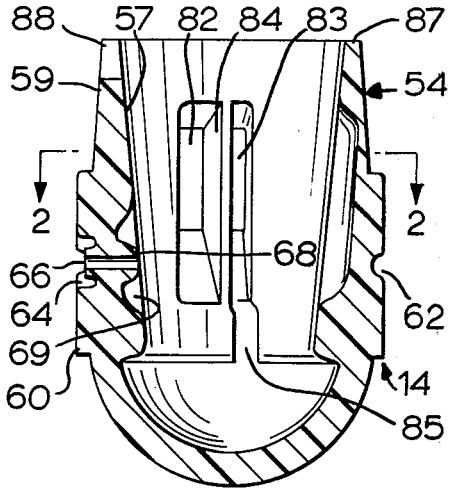
FIG. 3 is a section taken at the line 3—3 in FIGS. 1 and 2.

As best seen in FIGS. 1, 3, 4 and 5, a portion of the intermediate annular recess 62 is widened in a circular configuration to define an orifice recess 64, in the center of which is an outlet orifice 66. On the interior of the elastomeric member, the outlet orifice 66 opens through a poppet valve 68, which is surrounded by an internal pocket 69. As best seen in FIG. 3, the poppet valve 68 projects radially inwardly of the hypothetical extension of the frusto-conically shaped internal surface 57. Thus, when the elastomeric member 14 is slid over the frusto-concial portion 26 of the base member 12 and snugly embraces the same, the poppet valve 68 will be urged resiliently and deformably into closing contact with the curved base wall 27. In other words, in the absence of any excess outwardly deforming pressure in the internal pocket 69 around the poppet valve 68, the latter will normally "close" itself against the curved base walls 27 due to the fact that it projects slightly inwardly of the hypothetical extension of the frusto-conical internal surface 57 of the elastomeric member 14.

Figure 2:
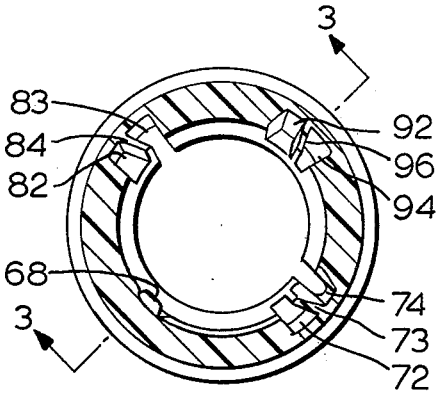
FIG. 2 is a section taken at the line 2—2 in FIG. 1.
Figure 4:
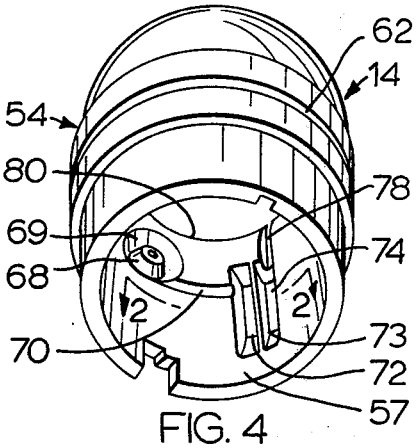
FIG. 4 is a perspective view of the elastomeric member of FIG. 1, taken from a different direction.
Figure 5:
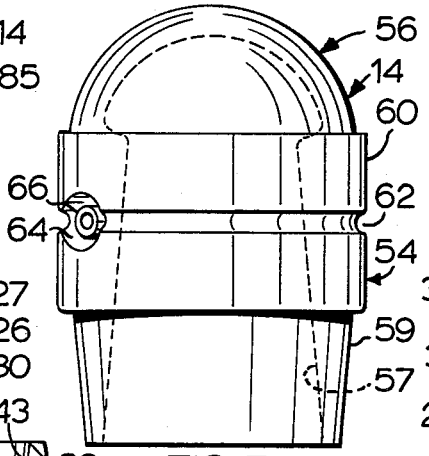
FIG. 5 is an elevational view of the elastomeric member of FIG. 1.

As best seen in FIG. 4, the interanl pocket 69 surrounding the poppet valve 68 is connected via an internal circumferential recess 70 with a downstream outlet compartment 72 which is separated by an outlet partition 73 from an upstream outlet compartment 74. In effect, the downstream compartment 72 and the upstream compartment 74 may be considered to constitute recessed means on the internal frusto-conical surface 57 of the elastomeric member 12. The partition 73 is integral with the elastomeric member 14, rests resiliently against the base wall 27 when the elastomeric member 14 is in assembled position as seen in FIG. 8, and is in sloping or oblique relationship with the base wall such that it defines in the upstream compartment 74 an acute angle with the part of the base wall it contacts. This sloping or oblique orientation of the partition 73 is best seen in FIG. 2.

When the different parts already described are assembled together in the condition shown in FIG. 8, the bulb portion 56 of the elastomeric member 14 defines with the end portion 26 of the base member 12 a pumping chamber 76. Returning to FIG. 4, means are provided to communicate the pumping chamber 76 with the upstream outlet compartment 74, the means consisting of a recessed channel 78 in the inside surface 57. As can be seen in FIG. 8, the recessed channel 78 opens through a kind of internal ledge 80, and thus extends beyond the end portion 29 of the frusto-conical portion 26, thereby permitting such communication.

The configuration of the elastomeric member 14 is such that it is difficult to show clearly the relative orientation of the different recesses and chambers located in the internal frusto-conical surface 57. To help make this as clear as possible, we will refer to angular displacements clockwise or anti-clockwise from the outlet orifice 66, as seen looking into the open lower end or mouth of the elastomeric member 14, similarly to the views of FIGS. 1 and 4. Thus, using this system, we would say from FIG. 4 that the compartments 72 and 73 are located approximately one-quarter turn (90°) anti-clockwise from the outlet orifice 66, which is the same location as the poppet valve 68.

Figure 1:
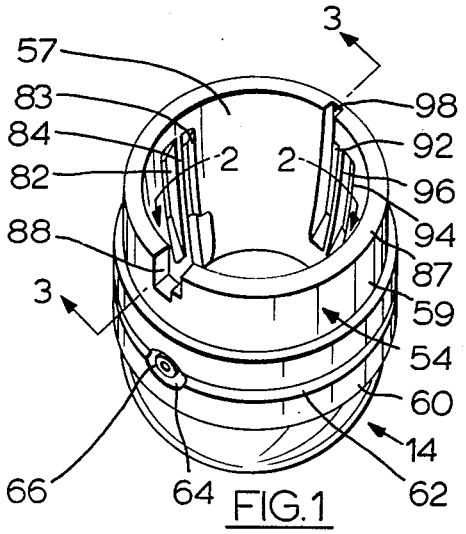
FIG. 1 is a perspective view of the elastomeric portion of the illustrated embodiment taken from one direction.

Looking now at FIGS. 1 and 3, it will be seen that, at a location approximately one-quarter turn (90°) in the clockwise direction from the outlet orifice 66 there is provided an upstream inlet compartment 82 and a downstream inlet compartment 83 divided by an inlet partition 84. As can be seen best in FIG. 2, the partition is integral with the elastomeric member 14, and is adapted to rest resiliently against the curved base wall 27 when the elastomeric member is in its assembled condition as shown in FIG. 8. Furthermore, the partition 84 defines in the upstream inlet compartment 82 an acute angle with the part of the base wall 27 it contacts, and thus is oblique with respect to the adjacent portion of the curved base wall 27. The downstream inlet compartment 83 communicates with the pumping chamber 76 by way of passageway means constituted by a recessed channel 85 in the internal frusto-conical surface 57.

It will thus be appreciated that the inlet compartments 82 and 83, the outlet compartments 72 and 74, and the pumping chamber 76 are adapted to constitute a pump capable of urging fluid to pass from the upstream inlet compartment 82 under the inlet partition 84, into and through the downstream inlet compartment 83, along the recessed channel 85 into the pumping chamber 76, out of the pumping chamber 76 along the recessed channel 78 and into the upstream outlet chamber 74, from there under the outlet partition 73 and into the downstream outlet compartment 72. From the latter, the fluid passes along the recess 70 and into the internal pocket 69. The entry of the fluid into the internal pocket 69 exerts an outward pressure on the region of the elastomeric member immediately surrounding the poppet valve 68 which ultimately has the effect of lifting the poppet valve 68 away from the curved base wall 27, thereby permitting the fluid to exit from the elastomeric member 14 through the outlet orifice 66.

In order to permit entry of the fluid from the reservoir 22 to the upstream inlet compartment 82, the elastomeric member 14 is angularly oriented with respect to the base member 12 in such a way that the opening 30 registers with and communicates with the upstream inlet compartment 82. In this manner, the upstream inlet compartment 82 is directly connected via passageway means with the fluid in the container 22. In order to ensure the proper angular registration, the rim 87 of the elastomeric member 14 is provided with a groove 88 adapted to register with a web located in the lower portion of the annular pocket 44 (see FIG. 6) and which would extend to the height shown by the broken line 90 in FIG. 6. The actual web, however, is not visible in FIG. 6 because it would occur just forwardly of the sectional plane of FIG. 6, i.e. slightly toward the reader from the plane of the paper. As will be obvious, in the particular embodiment illustrated the true displacement between the outlet orifice 66 and the upstream inlet compartment 82 is slightly less than 90°, although the general inlet chamber constituted by both compartments 82 and 83 is located approximately one-quarter turn in the clockwise direction from the outlet orifice 66.

Located approximately one-half turn (180°) away from the outlet orifice 66 in the internal frusto-conical surface 57 of the elastomeric member 14 is a vent chamber means again defined by recesses on the inside of the elastomeric member 14. The vent chamber recesses are best seen in FIG. 1, and are such as to define, with the curved base wall 27 when there-against, an upstream vent compartment 92 and a downstream vent compartment 94 divided from one another by a vent partition 96. Again the partition 96 is in sloping or oblique relation to the curved base wall 27 when there-against, and is adapted to rest resiliently against the base wall 27. Also, the partition 96 is integral with the elastomeric member 14. The means for admitting air from the exterior to the upstream vent compartment 92 includes a recessed channel 98 opening through the rim 87 of the elastomeric member 14, and an open-ended passageway 100 (FIG. 8) which passes through the upstanding collar 38 of the base member 12. The open-ended passageway 100 thus admits air from the exterior into an internal annular space defined at the bottom of the annular pocket 44 due to the fact that the elastomeric member 14, when in fully assembled condition, does not extend all the way to the bottom of the annular pocket 44. In turn, the recessed channel 98 is in communication with this open annular space, and therefore the downstream vent compartment 94 is in free communication with the exterior.

The downstream vent compartment 94 is positioned in such a way as to be in communication with the passage 52 described earlier and shown particularly in FIG. 6. The passage 52 merely opens into the space above the fluid or liquid in the container 22. Thus, there is provided a vent checkvalve constituted essentially by the compartments 92 and 94 and by the partition 96 which separates them. Air is able to pass under the partition 96 from the compartment 92 to 94 due to the sloping or oblique relation of the partition 96 with the portion of the curved base wall 27 it contacts, but neither air nor liquid is able to pass in the opposite direction from the compartment 94 to the compartment 92, since an excess of pressure in the compartment 94 over that in compartment 92 would have the effect of pressing the sloping partition 96 more firmly against the curved base wall 27. The same principle of checkvalve operation applies to all of the sloping or oblique partitions thus far described in this disclosure.

The shroud member 16 illustrated in FIG. 8 is seen to consist of a frusto-conical skirt 102, a substantially cylindrical inner collar 104, and an upstanding protective mask portion 106 which partly surrounds the bulb portion 56 of the elastomeric member 14, but which nonetheless permits digital access to the same to permit manual pumping. The inner collar 104 has a lower annular rib 107 which is adapted to register with the gallery 42 shown in FIG. 6, thereby to hold the shroud member 16 in proper orientation with respect to the base member 12. This proper orientation is such as not preclude the entry of external air through the open-ended passageway 1000 shown in FIG. 8.

The inner collar 104 also includes an intermediate annular rib 109 and an upper annular rib 110. For the latter two ribs 109 and 110 there is no complementary or mating recess in the elastomeric member 14. Instead, the ribs 109 and 110 are intended to press inwardly against the cylindrical external surface 60 of the elastomeric member 14 both above and below the intermediate annular recess 62, thereby to effectively seal off an annular strip around the elastomeric member 14 between the two ribs 109 and 110. This annular strip, of course, includes the intermediate annular recess 62 of the elastomeric member 14. The shroud member 16 finally includes a nozzle recess 112 into which a nozzle 114 is adapted to fit. A nozzle passageway 116 communicates the nozzle recess 112 with the internal surface of the inner collar 104 between the two ribs 109 and 110.

In operation, as the bulb portion 56 is manually depressed and released repeatedly, the pumping action described earlier draws fluid or liquid up along the feed tube 18 and into the upstream inlet compartment 82. By the process described earlier, the fluid or liquid passes through the pumping chamber 76 and the outlet compartments to finally emerge from the outlet orifice 66. The outlet orifice 66 is in communication with the annular space defined between the intermediate annular recess 62 and the internal wall of the inner collar 104 of the shroud member 16. The inwardly pressing effect of the ribs 109 and 110 is such as to contain this pressure within the annular strip area discussed earlier. However, as the pressure builds up there is a tendency for the elastomeric material of the member 14 to deform inwardly, thereby permitting access between the nozzle passageway 116 and the recess 62 as seen in FIG. 8. Thus, the pressurized fluid or liquid in the intermediate annular recess 62 is given access to the exterior by way of the nozzle passageway 116 and the nozzle 114.

The action of the poppet valve 68 is such as to cause the fluid or liquid exiting from the nozzle 14 to have a very sharp cut-off point in terms of pressure, thereby providing a very clean no-drip spray.

The appended claims utilize language which refers to "closed curved surfaces" and the like, when referring to the frusto-conical portion 26 of the base member 12 and the generally cylindrical or conical wall of the elastomeric member 14. This language is utilized because it is appreciated that strict conicity is not essential to the practice of this invention, and indeed that the mating surfaces of the elastomeric member and the base member do not really have to be surfaces of revolution. The latter do, of course, have considerable advantages in terms of molding techniques and ease of manufacture, but are not considered to be indispensible to this invention. What is important is that the elastomeric member be adapted snugly to embrace a particular portion of the base member in such a way that recesses in the elastomeric member can define with the base member appropriate chambers divided into compartments by appropriately sloping partitions.

I claim:

1. A fluid-handling device comprising:

a base member having a curved base wall closed upon itself and an end portion spanning across said curved base wall to define an edge thereof, and an elastomeric member having a. a closed curved wall portion which snugly embraces said curved base wall except for b. an inlet chamber defined in part by a first recess in said closed curved wall, said inlet chamber being divided into upstream and downstream compartments by an inlet partition integral with said elastomeric member, the partition resting resiliently against the base wall and defining in the upstream compartment an acute angle with the part of the base wall it contacts; and except for c. an outlet chamber defined in part by a second recess in said closed curved wall, said outlet chamber being divided into upstream and downstream compartments by an outlet partition integral with said elastomeric member, the partition resting resiliently against the base wall and defining in said last-mentioned upstream compartment an acute angle with the part of the base wall it contacts;

d. and a deformable, self-restoring bulb portion capping said closed curved wall portion and defining a pumping chamber with said end portion of the base member, the fluid-handling device further including: passageway means joining the pumping chamber to the downstream inlet compartment and to the upstream outlet compartment, means communicating the upstream inlet compartment with a fluid reservoir, and means permitting exit of fluid from said downstream outlet compartment.

2. The invention claimed in claim 1, in which said passageway means includes two recessed channels in said closed curved wall portion, and in which said means communicating said upstream inlet compartment with a fluid reservoir includes an opening in said curved base wall within said upstream inlet compartment, and a feed tube having one end at said opening and the other end in the fluid reservoir.

3. The invention claimed in claim 1, in which the means permitting exit of fluid from said downstream outlet compartment includes an outlet orifice in said closed curved wall portion.

4. The invention claimed in claim 2, in which the means permitting exit of fluid from said downstream outlet compartment includes an outlet orifice surrounded by a recessed pocket in said closed curved wall portion, the outlet orifice being surrounded by a poppet valve which, in the absence of pumping pressure in the pocket, is urged resiliently into closing contact with said curved base wall.

5. The invention claimed in claim 4, further including a shroud member surrounding said elastomeric member, the shroud member having an opening providing digital access to said bulb portion and a nozzle in communication with said outlet orifice.

6. The invention claimed in claim 1, in which the elastomeric member further has a vent chamber defined in part by a third recess in said closed curved wall, said vent chamber being divided into upstream and downstream compartments by a vent partition integral with said elastomeric member, the partition resting resiliently against the base wall and defining in the upstream compartment an acute angle with the part of the base wall it contacts, the fluid-handling device including means for admitting air from the exterior to said vent upstream compartment, the base member including a passage by which air in the vent downstream compartment can enter the fluid reservoir.

7. The invention claimed in claim 6, in which the fluid-handling device further includes a fluid container upon which said base member and elastomeric member are mounted, the fluid container constituting said fluid reservoir.

8. The invention claimed in claim 5, in which said shroud acts to maintain said elastomeric member in snug surrounding engagement with said base member.

9. The invention claimed in claim 1, in which the curved base wall is a conical frustum, and in which the closed curved wall portion of the elastomeric member is complementary with said curved base wall.

10. For use with a base member having a curved base wall closed upon itself and an end portion spanning across said curved base wall to define an edge thereof, an integral elastomeric member comprising:

a. a closed curved wall portion having an inside and an outside; an inlet recess on the inside divided into upstream and downstream compartments by an inlet partition which is integral with said elastomeric member, which is adapted to rest resiliently against said base wall when the closed curved wall portion snugly embraces said curved base wall, and which defines in the upstream compartment an acute angle with the part of the curved base wall it contacts when so resting; an outlet recess on the inside divided into upstream and downstream compartments by an outlet partition which is integral with said elastomeric member, which is adapted to rest resiliently against said base wall when the closed curved wall portion snugly embraces said curved base wall, and which defines in said last-mentioned upstream compartment an acute angle with the part of the curved base wall it contacts when so resting; and b. a deformable, self-restoring bulb portion capping said closed curved wall and adapted to define a pumping chamber with said end portion of the base member; and c. recesses on said inside joining the pumping chamber to the downstream inlet compartment and to the upstream outlet compartment.

11. The invention claimed in claim 10, further comprising an outlet orifice in said closed curved wall portion communicating with said downstream outlet compartment.

12. The invention claimed in claim 11, in which the outlet orifice is surrounded by a poppet valve which, in the absence of pumping pressure in that compartment, is adapted to rest resiliently in closing contact with said curved base wall when the closed curved wall portion snugly embraces said curved base wall.

13. The invention claimed in claim 10, in which the inside of the closed curved wall portion defines a conical frustum.

* * * * *